US009640916B2

(12) United States Patent
Nakai et al.

(10) Patent No.: US 9,640,916 B2
(45) Date of Patent: May 2, 2017

(54) SHIELD CONNECTOR

(71) Applicant: YAZAKI CORPORATION, Minato-ku, Tokyo (JP)

(72) Inventors: Satoshi Nakai, Shizuoka (JP); Toru Suzuki, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/930,699

(22) Filed: Nov. 3, 2015

(65) Prior Publication Data

US 2016/0056584 A1 Feb. 25, 2016

Related U.S. Application Data

(63) Continuation of application No. PCT/JP2014/061055, filed on Apr. 18, 2014.

(30) Foreign Application Priority Data

May 7, 2013 (JP) ..... 2013-097412

(51) Int. Cl.

| | |
|---|---|
| ***H01R 13/56*** | (2006.01) |
| ***H01R 13/506*** | (2006.01) |
| ***H01R 13/6581*** | (2011.01) |
| ***H01R 13/6596*** | (2011.01) |
| ***H01R 103/00*** | (2006.01) |

(52) U.S. Cl.

CPC ..... *H01R 13/6581* (2013.01); *H01R 13/506* (2013.01); *H01R 13/56* (2013.01); *H01R 13/6596* (2013.01); *H01R 2103/00* (2013.01)

(58) Field of Classification Search

CPC ..... H01R 13/506; H01R 13/648

See application file for complete search history.

(56) References Cited

U.S. PATENT DOCUMENTS

| | | | | |
|---|---|---|---|---|
| 6,962,504 | B2 * | 11/2005 | Fukui | H01R 13/567 439/466 |
| 7,507,125 | B2 * | 3/2009 | Okamura | H01R 13/506 439/680 |
| 2009/0093157 | A1 | 4/2009 | Aoki et al. | |

FOREIGN PATENT DOCUMENTS

| | | | |
|---|---|---|---|
| JP | H07-153529 | A | 6/1995 |
| JP | 2009-087888 | A | 4/2009 |
| JP | 2010-211935 | A | 9/2010 |
| KR | 10-2011-0050997 | A | 5/2011 |
| KR | 10-1255790 | B1 | 4/2013 |
| WO | 2011097007 | A1 | 8/2011 |
| WO | 2013092376 | A1 | 6/2013 |

OTHER PUBLICATIONS

German Official Action issued on Jan. 17, 2017 in the counterpart German patent application.

* cited by examiner

*Primary Examiner* — Amy Cohen Johnson
*Assistant Examiner* — Oscar C Jimenez
(74) *Attorney, Agent, or Firm* — Mots Law, PLLC

(57) ABSTRACT

A housing-side lock part provided on a surface of a housing where an electric wire extraction part is formed and a protector-side lock part of a protector covering an outer circumference of the electric wire extraction part of the housing are engaged with each other and fix a shield shell to the housing through the protector, with a portion of the shield shell in contact with the surface of the housing where the electric wire extraction part is formed being sandwiched between the housing and the protector.

13 Claims, 9 Drawing Sheets

SHIELD CONNECTOR

CROSS REFERENCE TO RELATED APPLICATION

This application is a Continuation of PCT Application No. PCT/JP2014/061055, filed on Apr. 18, 2014, and claims the priority of Japanese Patent Application No. 2013-097412, filed on May 7, 2013, the content of both of which is incorporated herein by reference.

BACKGROUND

Technical Field

The disclosure relates to a shield connector having a shield shell which is assembled to a housing storing a terminal.

Related Art

FIGS. 1 and 2 illustrate a shield connector having a shield shell which is assembled to a housing storing a terminal. In FIGS. 1 and 2, a shield connector 100 includes a housing 102 storing a terminal 101, and a shield shell 103 arranged at an outer circumference of the housing 102. A lock arm 105 having elasticity is formed on a surface 104 at an electric wire extraction side (right side in FIG. 2) of the housing 102 to project in an electric wire extraction direction. The shield shell 103 is provided with a locking hole 106 with which the lock arm 105 is engaged.

In the above configuration, the shield shell 103 is mounted to the housing 102, and the lock arm 105 is engaged with the locking hole 106 of the shield shell 103, whereby the shield shell 103 is directly fixed to the housing 102.

A shield connector similar to the above shield connector is also described in Japanese Unexamined Patent Application Publication No. 2009-87888.

SUMMARY

The above shield connector 100 needs a length for which the lock arm 105 formed on the surface 104 of the housing 102 at the electric wire extraction side is deformed, and at the same time, needs to secure a region in which the lock arm 105 is deformed. For this, a gap S has to be formed on the surface 104 at the electric wire extraction side of the housing 102, when the shield shell 103 is arranged. The size of the shield connector 100 is increased to secure this gap S.

The disclosure aims to provide a shield connector that can be downsized without requiring a gap for fixing a shield shell on a surface of a housing at an electric wire extraction side.

A shield connector in accordance with some embodiments includes: a housing that houses a terminal, and has an electric wire extraction part and a housing-side lock part provided on a surface of the housing where the electric wire extraction part is formed; a shield shell arranged on an outer circumference of the housing; and a protector that has a protector-side lock part engaged with the housing-side lock part and covers an outer circumference of the electric wire extraction part of the housing. The housing-side lock part and the protector-side lock part are engaged with each other and fix the shield shell to the housing through the protector, with a portion of the shield shell in contact with the surface of the housing where the electric wire extraction part is formed being sandwiched between the housing and the protector.

According to the above configuration, when the shield shell and the protector are assembled to the housing, the portion of the shield shell contacting the surface of the housing where the electric wire extraction part is formed is sandwiched between the housing and the protector, and with this state, the housing-side lock part and the protector-side lock part are engaged with each other to fix the shield shell to the housing through the protector. This eliminates the need to form a gap for fixing the shield shell on the surface of the housing where the electric wire extraction part is formed, whereby the shield connector can be downsized.

The protector may include: a base member; and a cover connected to the base member through a hinge and capable of opening and closing at least a region of the base member toward an assembly direction of the base member.

The housing-side lock part may be provided as a pair of left and right housing-side lock parts, and the protector-side lock part may be provided as a pair of left and right protector-side lock parts. Each of the pair of housing-side lock parts may include: a locked part extending in an electric wire extraction direction of the electric wire extraction part; and a stopper preventing displacement of the protector-side lock part engaged with the locked part in the electric wire extraction direction. Each of the pair of protector-side lock parts may include: an arm flexibly deformable in a direction orthogonal to the electric wire extraction direction; and a locking claw part provided at a tip end of the arm. The arms may be flexibly deformed in opposite directions to allow the locking claw parts to be engaged with the locked parts upon the protector being assembled to the housing from the direction orthogonal to the electric wire extraction direction.

The housing may include a pair of housing-side auxiliary lock parts. The protector may include a pair of protector-side auxiliary lock parts. Each of the pair of housing-side auxiliary lock parts may include a position restriction part extending in the electric wire extraction direction of the electric wire extraction part, and a stopper preventing displacement of the protector-side auxiliary lock part in the electric wire extraction direction. The pair of protector-side auxiliary lock parts may be engaged with the position restriction parts and the stoppers of the pair of housing-side auxiliary lock parts, upon the protector being assembled to the housing from the direction orthogonal to the electric wire extraction direction.

DETAILED DESCRIPTION

In the following, an embodiment of the present invention will be described in detail with reference to the drawings.

Figure 9:
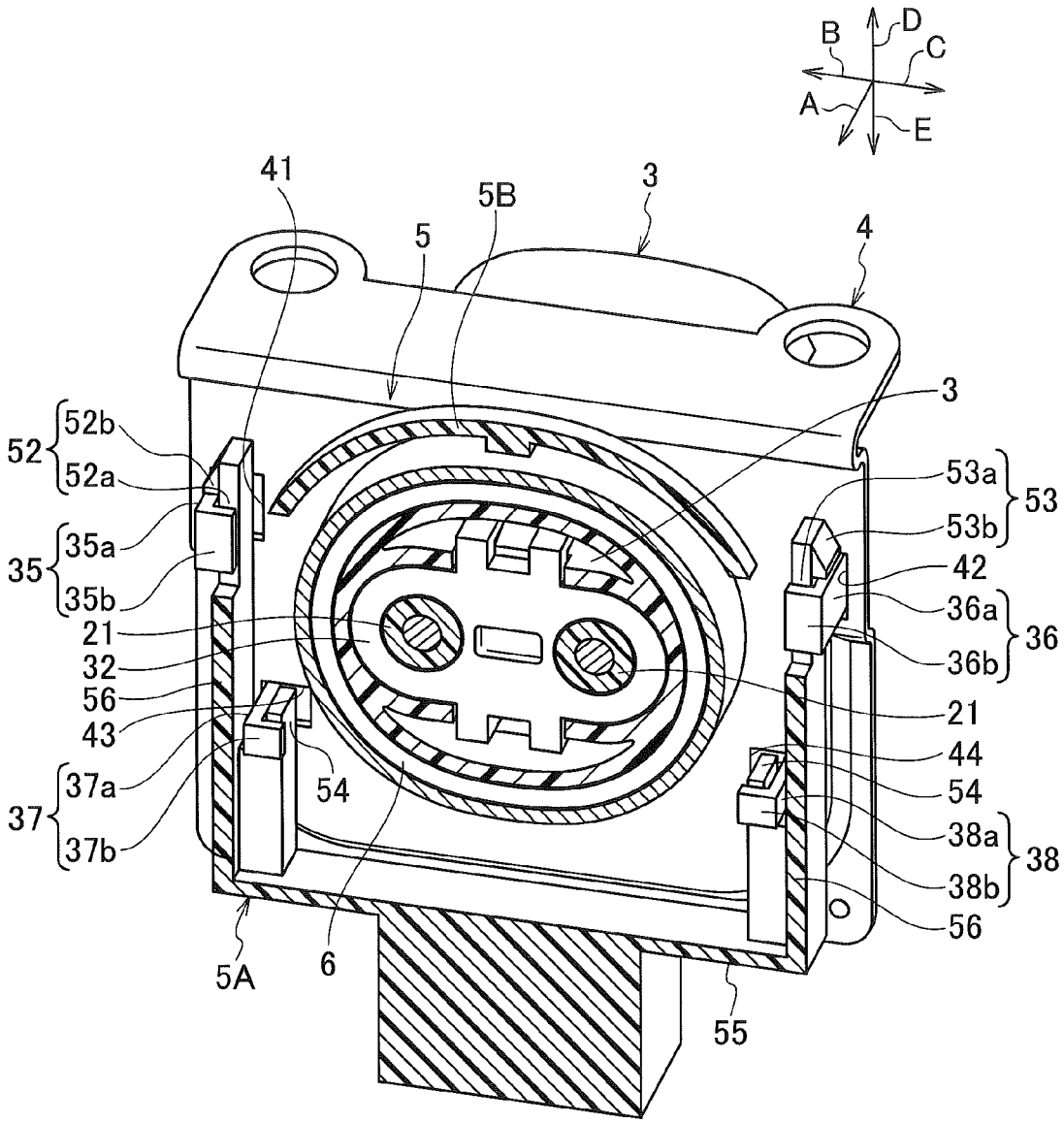
FIG. 9 is a perspective view partially cut for describing a structure of a lock part and other parts according to one embodiment of the present invention.

FIGS. 3 to 9 illustrate one embodiment of the present invention. A shield connector 1 according to the present embodiment is a high-voltage female connector connected to an inverter case (not illustrated), and is fitted to a terminal block (not illustrated) in the inverter to be mounted to the inverter case. FIG. 9 is a perspective view corresponding to FIG. 8 (longitudinal sectional view), and it illustrates a housing 3, a shield shell 4, and a protector 5 in a state of being partially cut away for easy understanding of structures of lock parts 35 to 38 and 52 to 54.

Figure 1:
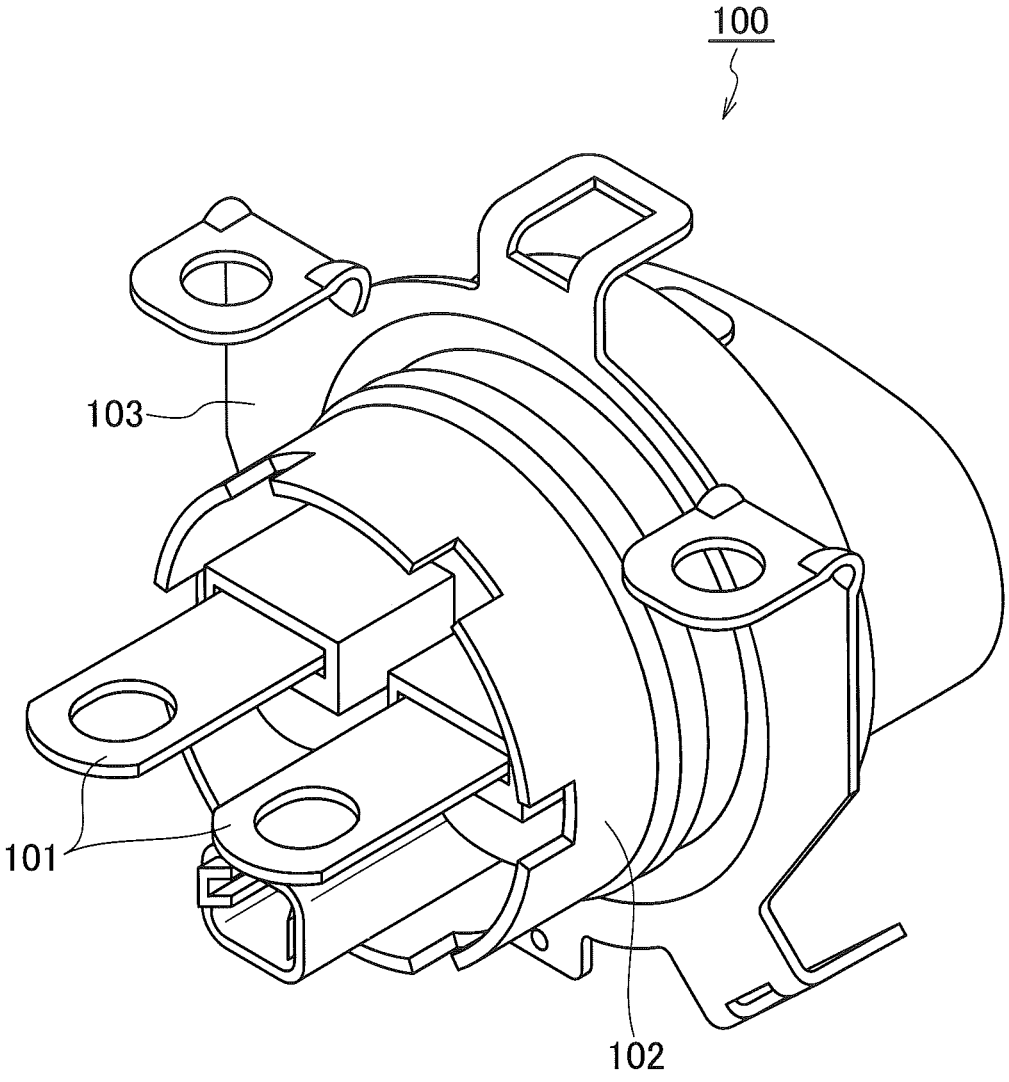
FIG. 1 RELATED ART
FIG. 1 is an assembled perspective view of a related shield connector.
Figure 2:
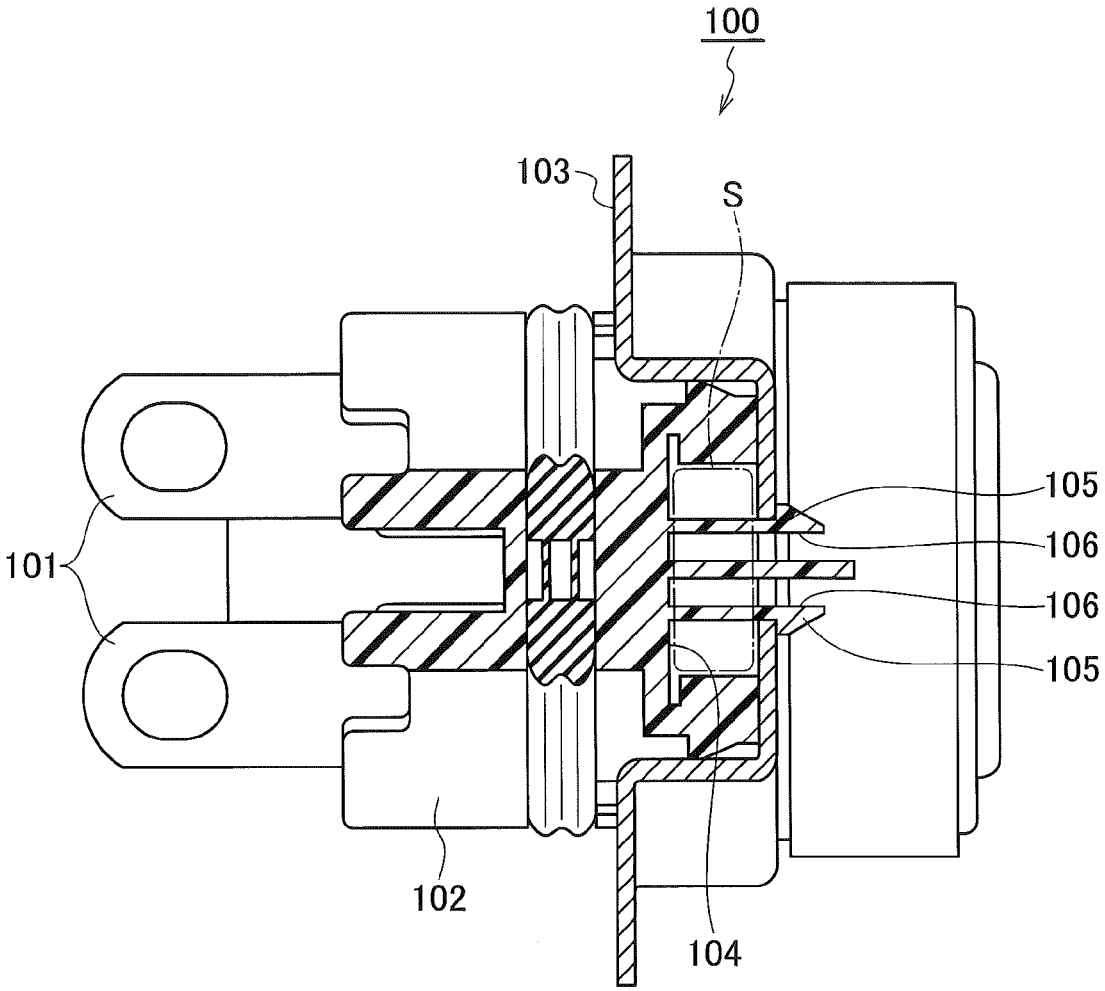
FIG. 2 RELATED ART
FIG. 2 is a transverse sectional view of the related shield connector.
Figure 3:
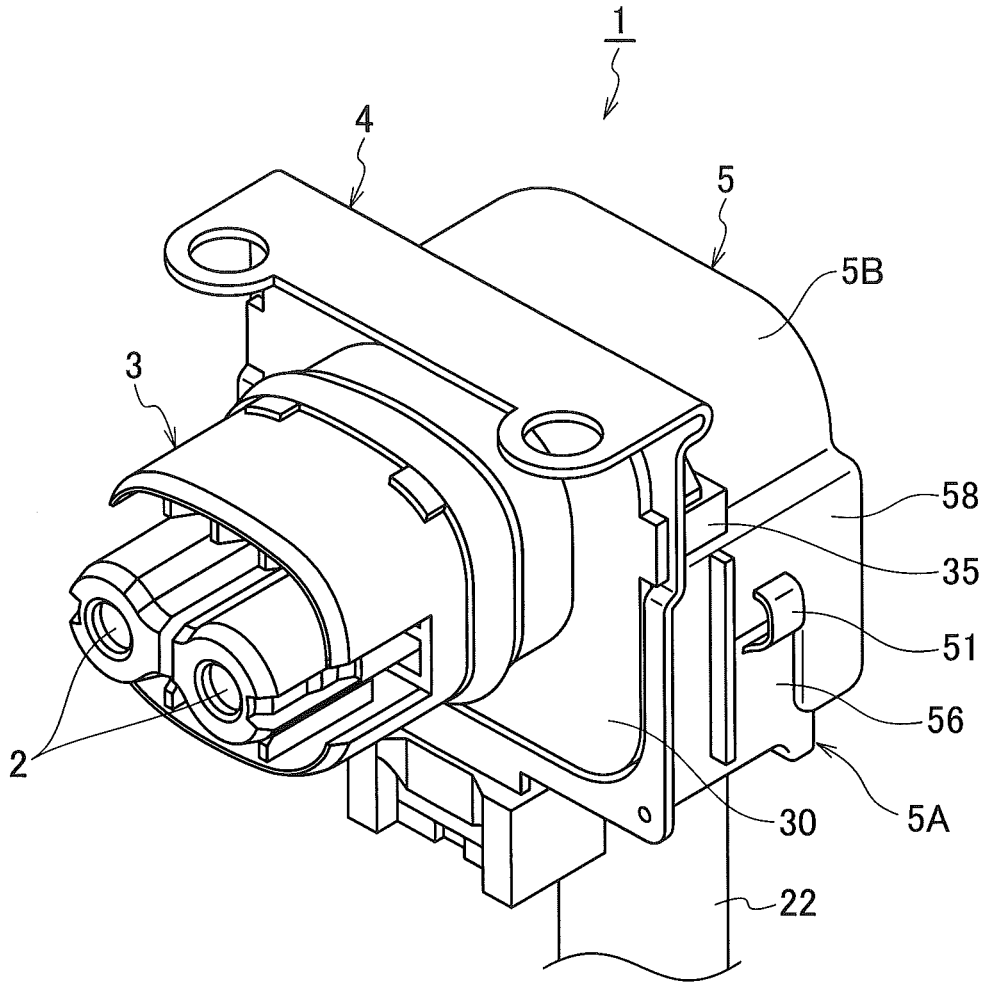
FIG. 3 is an assembled perspective view of a shield connector according to one embodiment of the present invention.
Figure 4:
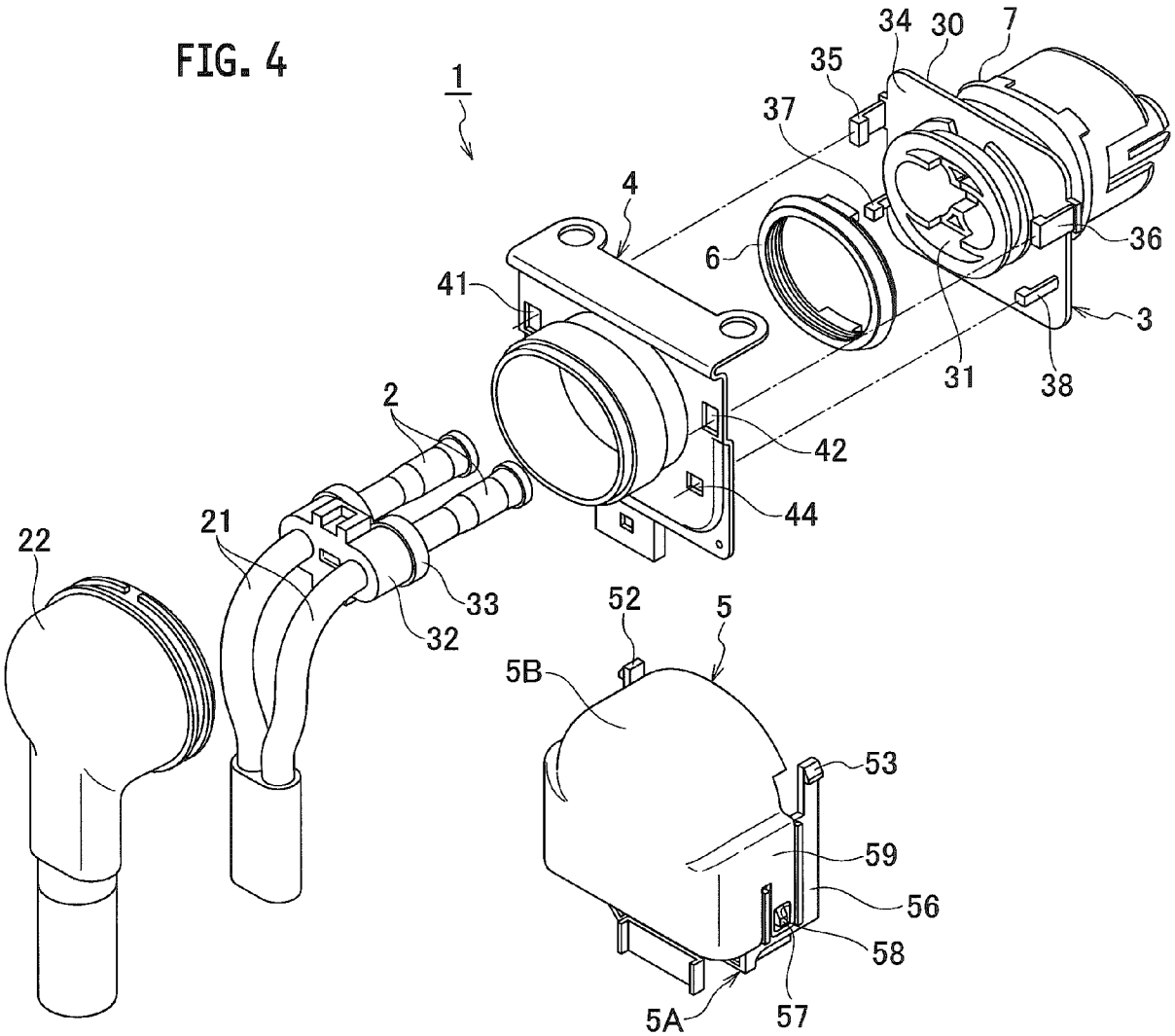
FIG. 4 is an exploded perspective view of the shield connector according to one embodiment of the present invention.
Figure 5:
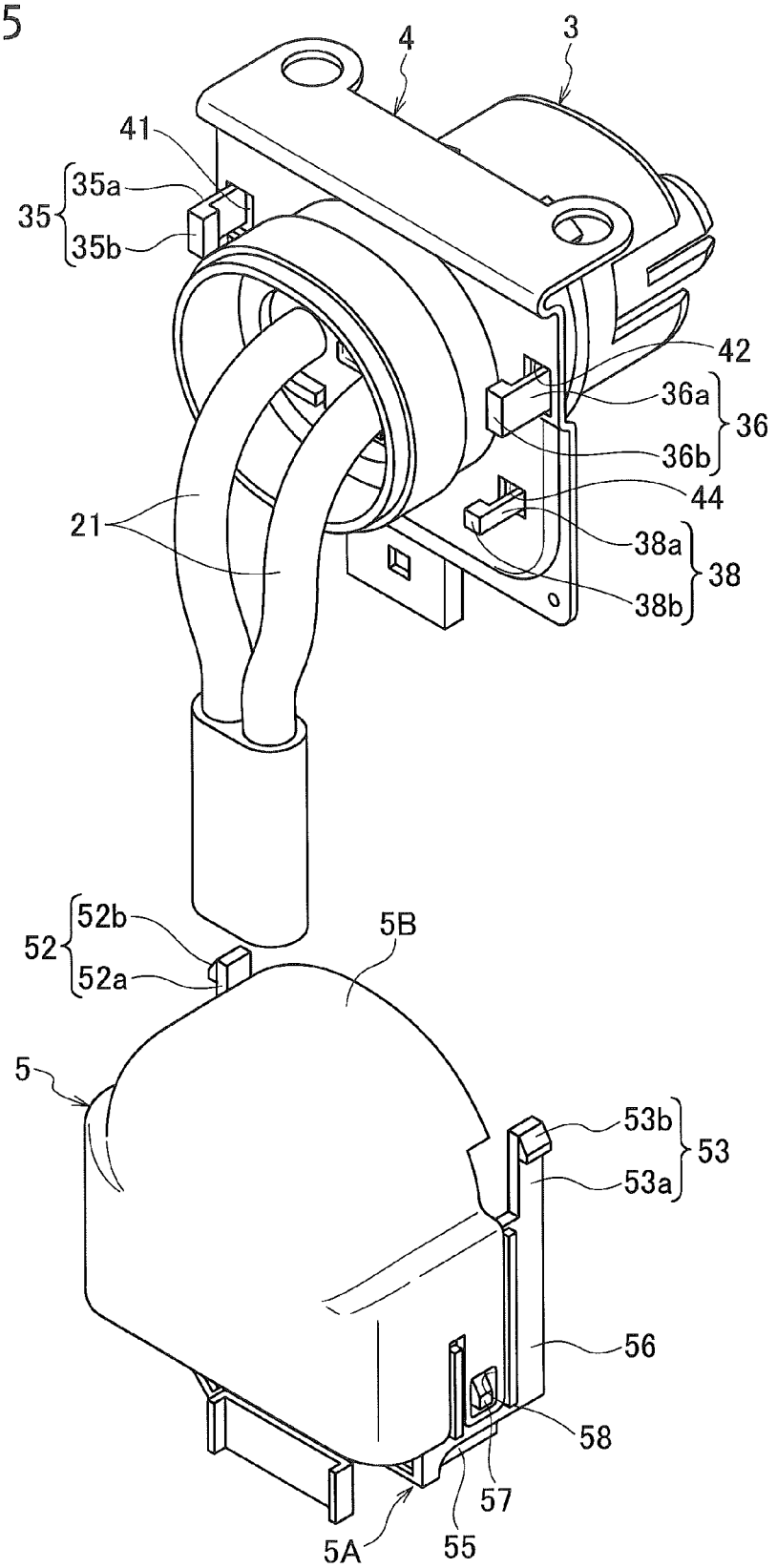
FIG. 5 is a perspective view illustrating a main part of the shield connector according to one embodiment of the present invention.
Figure 6:
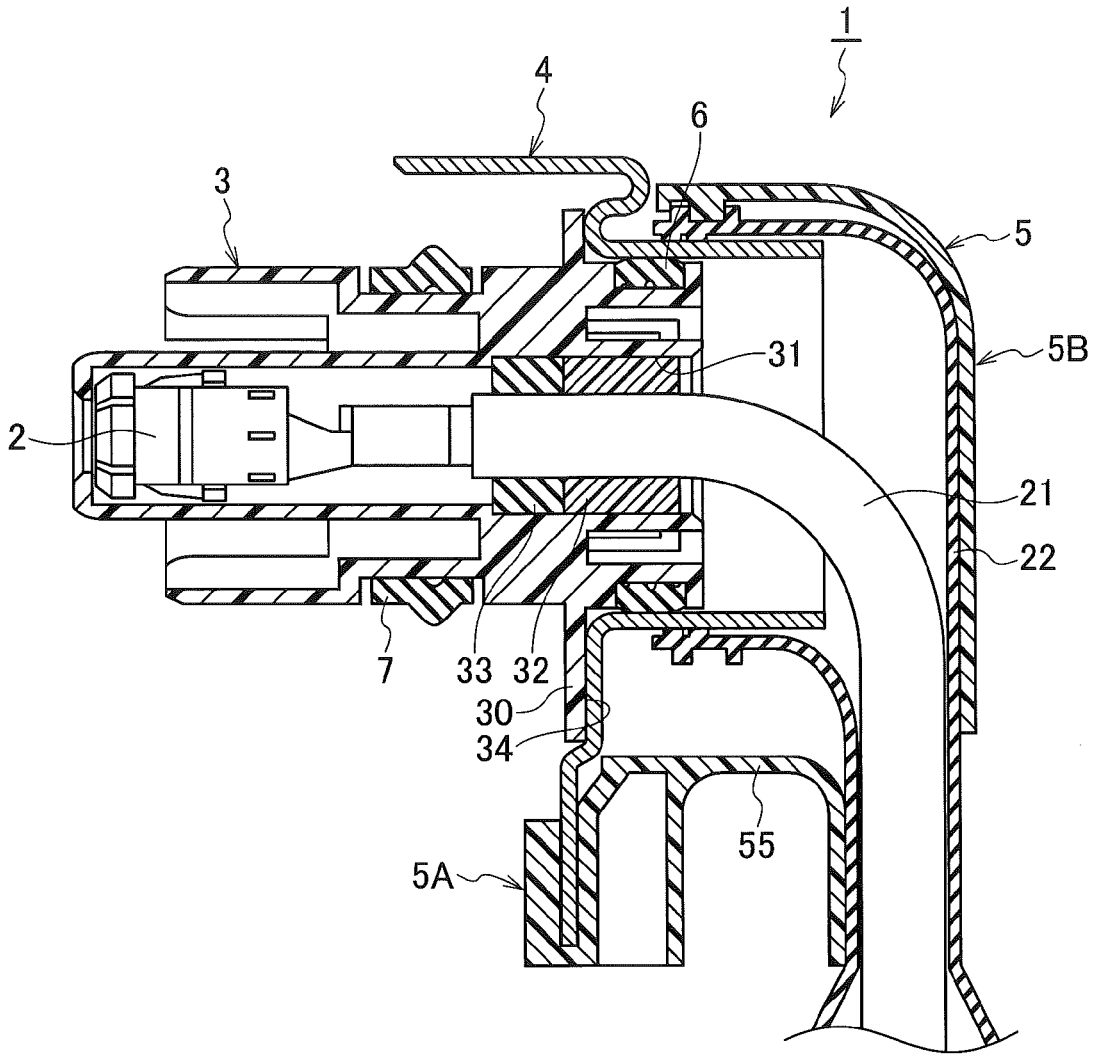
FIG. 6 is a longitudinal sectional view of the shield connector according to one embodiment of the present invention.
Figure 7:
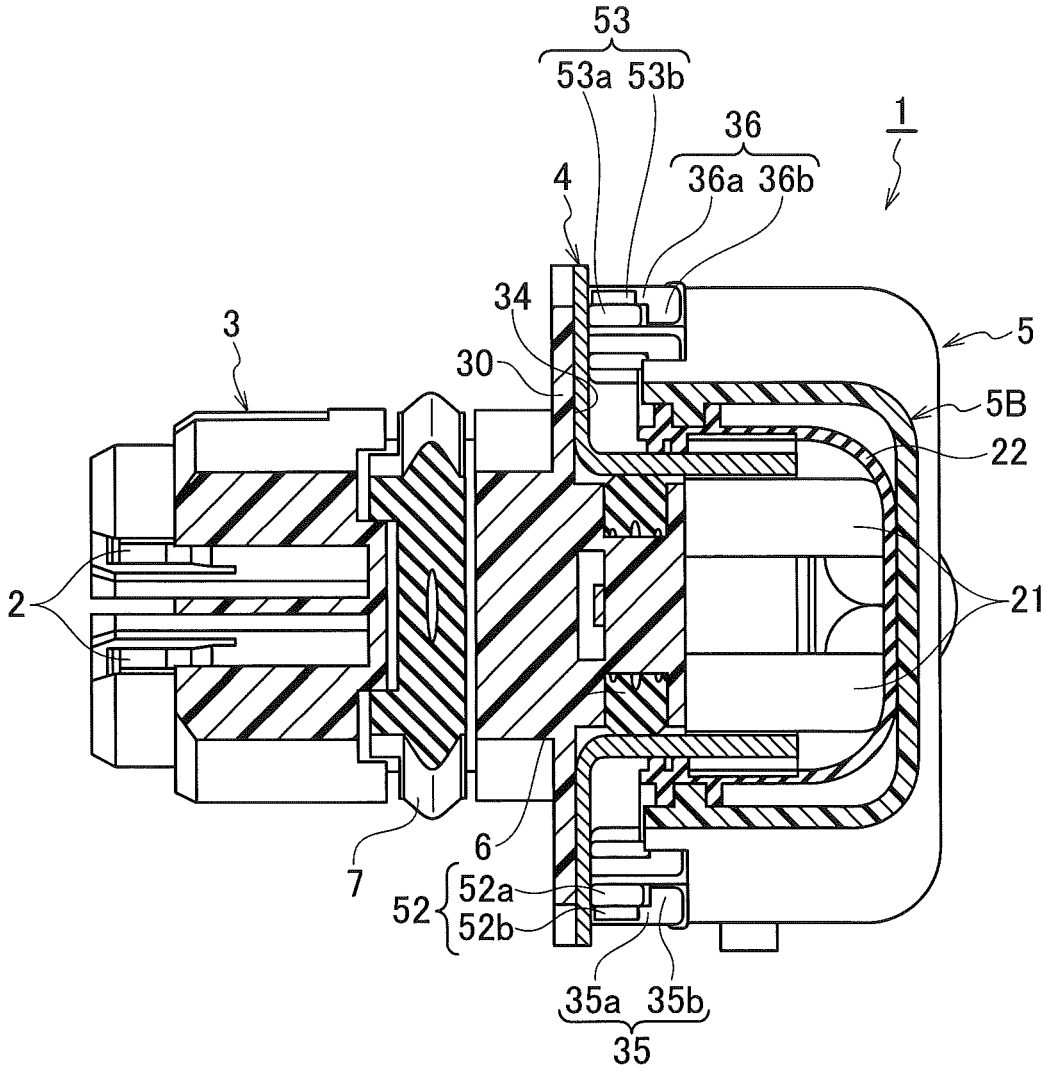
FIG. 7 is a transverse sectional view of the shield connector according to one embodiment of the present invention.
Figure 8:
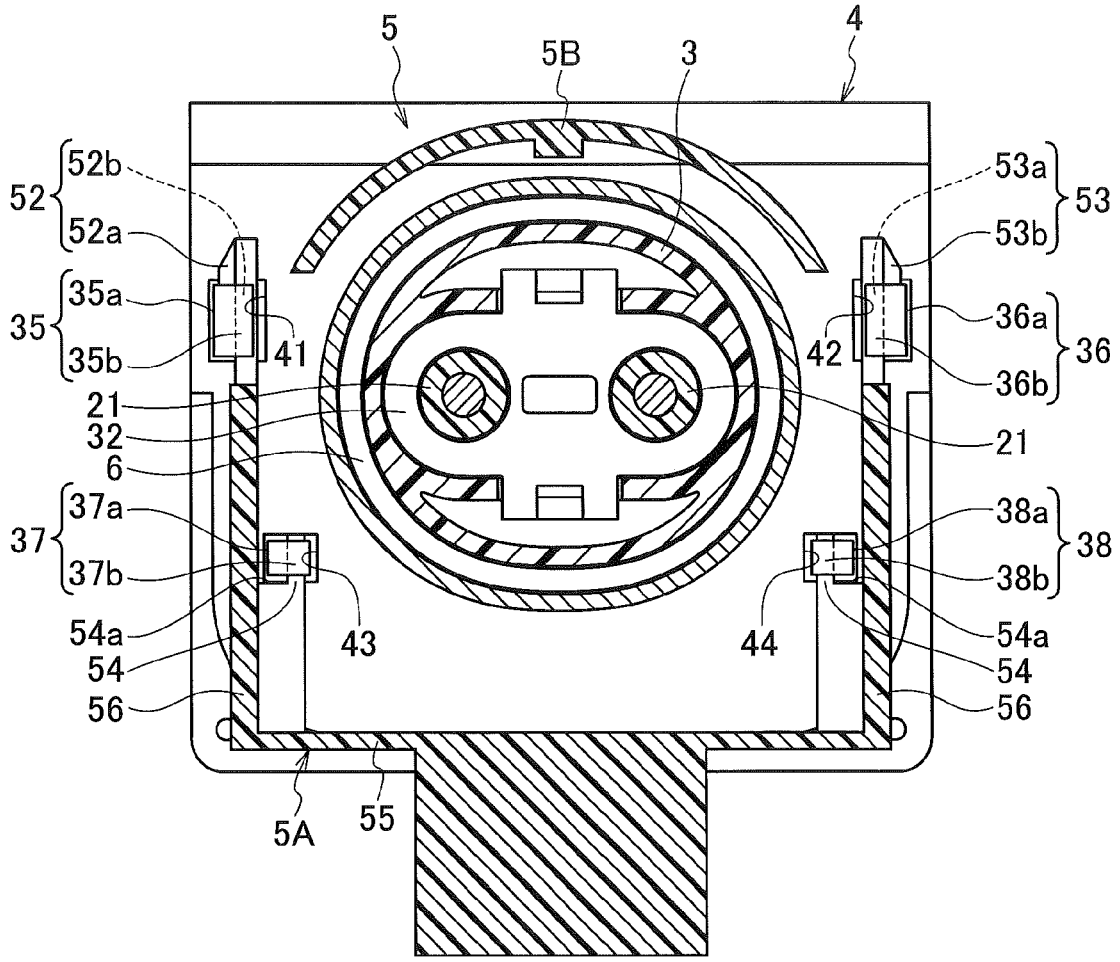
FIG. 8 is a longitudinal sectional view for describing a structure of a lock part and other parts according to one embodiment of the present invention.

As illustrated in FIGS. 3 and 4, the shield connector 1 includes the almost cylindrical housing 3 that stores a pair of left and right terminals 2, the shield shell 4 arranged on the outer circumference of the housing 3, and the protector 5 arranged to cover the outer circumference of an electric wire extraction part 31 on the housing 3. A portion between the outer circumference of the housing 3 and the inner circumference of the shield shell 4 is sealed by a shell packing 6, and a unit packing 7 is formed on the outer circumference of the housing 3.

An electric wire 21 is connected to the pair of terminals 2. The electric wire 21 extends in an electric wire extraction direction (a direction indicated by an arrow A in FIG. 9) from the housing 3, is bent downward in the middle, and covered by a rubber boots 22. The rubber boots 22 is covered by the protector 5.

The electric wire extraction part 31 for extracting the electric wire 21 to the outside and a flange part 30 projecting in the direction orthogonal to the electric wire extraction direction are provided at the back side of the housing 3. A rear holder 32 for holding the electric wire 21 is provided at the electric wire extraction part 31, and a rubber stopper 33 for sealing the portion between the housing 3 and the electric wire 21 is provided at the end anterior to the rear holder 32.

A pair of left and right housing-side lock parts 35 and 36 arranged above later-described rising side parts 56 of the protector 5 is formed on a surface 34 of the flange part 30 located at the side of the housing 3 where the electric wire extraction part 31 is present. These lock parts 35 and 36 project from the surface 34 of the flange part 30, and includes locked parts 35*a* and 36*a* extending in the electric wire extraction direction of the electric wire extraction part 31 and stoppers 35*b* and 36*b* that prevent the displacement of the lock parts 52, 53, which are locked to the locked parts 35*a* and 36*a* and provided to the protector 5, in the electric wire extraction direction.

The housing 3 is provided with the pair of left and right housing-side lock parts 35 and 36 and a pair of left and right housing-side auxiliary lock parts 37 and 38 arranged inward from the pair of left and right housing-side lock parts 35 and 36. These auxiliary lock parts 37 and 38 project from the surface 34 of the flange part 30, and includes position restriction parts 37*a* and 38*a* extending in the electric wire extraction direction of the electric wire extraction part 31 and stoppers 37*b* and 38*b* that prevent the displacement of later-described protector-side auxiliary lock parts 54 in the electric wire extraction direction.

The shield shell 4 is provided with insertion holes 41 and 42 through which the housing-side lock parts 35 and 36 are respectively inserted and insertion holes 43 and 44 through which the housing-side auxiliary lock parts 37 and 38 are respectively inserted.

The protector 5 includes a base member 5A, and a cover 5B that is formed on the base member 5A so as to be capable of being vertically opened and closed through a hinge 51. The base member 5A includes a bottom plate part 55 and a pair of rising side parts 56 rising from both of left and right ends of the bottom plate part 55. The cover 5B has a shape of covering a top surface, left and right side surfaces, and a back surface of the base member 5A. The hinge 51 connects one of the rising side parts 56 and one end of the cover 5B to each other. The cover 5B can be displaced between a covering position (position illustrated in FIGS. 3, 4, etc.) for covering spaces on the top surface, left and right side surfaces, and the back surface of the base member 5A and an open position for opening these spaces by utilizing the flexural deformation of the hinge 51. Specifically, the protector 5 is configured such that the base member 5A and the cover 5B are connected through the hinge 51, and the cover 5B is formed to be capable of opening and closing at least the region of the base member 5A in the assembly direction (region on the top surface). The cover 5B is locked to the base member 5A in the closing position in such a manner that a locking claw 57 of the base member 5A and a locking hole 58 of the cover 5B are engaged with each other (see FIG. 3).

A pair of left and right protector-side lock parts 52 and 53 respectively engaged with the housing-side lock parts 35 and 36 is formed above the rising side parts 56 of the protector 5. These lock parts 52 and 53 project upward from the rising side parts 56, and includes arms 52*a* and 53*a* that are flexibly deformed in the direction (direction indicated by arrows B and C in FIG. 9) orthogonal to the electric wire extraction direction, and locking claw parts 52*b* and 53*b* provided at the tip ends of the arms 52*a* and 53*a*. In addition, a pair of left and right protector-side auxiliary lock parts 54 is formed on the rising side parts 56 of the protector 5 together with the pair of left and right protector-side lock parts 52 and 53. The auxiliary lock parts 54 are arranged inside of the protector-side lock parts 52 and 53. An upper stopper step surface 54*a* is formed on the top of each of the auxiliary lock parts 54. Upon the assembly of the protector 5, the position restriction parts 37*a* and 38*a* are in contact with the upper stopper step surfaces 54*a*, whereby the protector 5 is positioned.

With the above configuration, upon the assembly of the shield connector 1, the shell packing 6 and the shield shell 4 are attached to the housing 3; the terminal 2, the electric wire 21, and the rear holder 32 are assembled to the housing 3; the rubber boots 22 is attached to cover the electric wire 21; and the protector 5 having the cover 5B in its open position is assembled to the housing 3 from the direction (direction indicated by an arrow D in FIG. 9) orthogonal to the electric wire extraction direction. Thus, the portion of the shield shell 4 contacting the surface (i.e., the surface where the electric wire extraction part 31 is formed) 34 of the flange part 30 of the housing 3 is sandwiched between the flange part 30 of the housing 3 and the protector 5, and with this state, the housing-side lock parts 35 and 36 and the protector-side lock parts 52 and 53 are engaged with each other, whereby the shield shell 4 is fixed to the housing 3 through the protector 5. The cover 5B of the protector 5 is displaced to the closing position, and the cover 5B is locked to the base member 5A. Thus, the portion of the electric wire 21 extracted from the back surface of the housing 3 is covered by the protector 5.

In addition, when the protector 5 is assembled to the housing 3 from the direction orthogonal to the electric wire extraction direction as described above, the locking claw parts 52*b* and 53*b* of the pair of protector-side lock parts 52 and 53 are engaged with the locked parts 35*a* and 36*a* due to the flexural deformation of the arms 52*a* and 53*a* in the opposite directions, i.e., in the directions indicated by the arrows B and C in FIG. 9. Simultaneously, the pair of protector-side auxiliary lock parts 54 is respectively engaged with the position restriction parts 37*a* and 38*a* and the stoppers 37*b* and 38*b* of the housing-side auxiliary lock parts 37 and 38.

As described above, the shield shell 4 can be fixed to the housing 3 with the state in which the shield shell 4 is in contact with the surface 34 of the flange part 30 located on the portion of the housing 3 where the electric wire extraction part 31 is present. This configuration eliminates the need to form a gap for fixing the shield shell 4 to the surface 34 located on the portion of the housing 3 where the electric wire extraction part 31 is present, whereby the shield connector 1 can be downsized.

The protector 5 is configured such that the base member 5A and the cover 5B are connected through the hinge 51, and the cover 5B is formed to be capable of opening and closing at least the region of the base member 5A in the assembly direction. With this configuration, when the protector 5 is assembled to the housing 3 from the direction orthogonal to the electric wire extraction direction, the base member 5A can be moved to a predetermined assembly position without causing interference between the cover 5B and the electric wire W, and the protector 5 can be assembled. Since the cover 5B is connected to the base member 5A through the hinge 51, the cover 5B can easily and surely be assembled to the base member 5A. The inside state of the protector 5 can easily be confirmed by changing the cover 5B in its closing position to its open position after the protector 5 is assembled. The cover 5B may be a member separated from the base member 5A without being connected to the base member 5A through the hinge 51.

The displacement between the protector 5 and the housing 3 is prevented by the locking claw parts 52*b* and 53*b* and the locked parts 35*a* and 36*a* in the assembly releasing direction (direction indicated by an arrow E in FIG. 9), and prevented by the arms 52*a* and 53*a* and the stoppers 35*b* and 36*b* in the electric wire extraction direction (i.e., the direction in which the protector 5 and the housing 3 are away from each other). Accordingly, the protector 5 and the housing 3 are tightly fixed. Consequently, the shield shell 4 can tightly be fixed to the housing 3.

The pair of housing-side auxiliary lock parts 37 and 38 and the protector-side auxiliary lock parts 54 prevent the displacement of the arms 52*a* and 53*a* in the deformation direction and in the electric wire extraction direction. Accordingly, the protector 5 and the housing 3 are more tightly fixed. Therefore, the shield shell 4 can more tightly be fixed to the housing 3.

The protector-side lock parts 52 and 53 and the housing-side lock parts 35 and 36 are engaged with each other in the state in which they are exposed to the outside of the protector 5, whereby the engagement can visually be confirmed from the outside of the protector 5.

In this way, the present invention includes various embodiments not described above. Therefore, the scope of the present invention is determined only by the invention identification matters according to claims reasonable from the foregoing description.

What is claimed is:

1. A shield connector comprising:

a housing that houses a terminal, and has an electric wire extraction part and a housing-side lock part provided on a surface of the housing where the electric wire extraction part is formed;

a shield shell arranged on an outer circumference of the housing; and a protector that has a protector-side lock part engaged with the housing-side lock part and covers an outer circumference of the electric wire extraction part of the housing, wherein the housing-side lock part and the protector-side lock part are engaged with each other and fix the shield shell to the housing through the protector, with a portion of the shield shell in contact with the surface of the housing where the electric wire extraction part is formed being sandwiched between the housing and the protector, the housing-side lock part is provided as a pair of left and right housing-side lock parts, and the protector-side lock part is provided as a pair of left and right protector-side lock parts, each of the pair of housing-side lock parts includes:

a locked part extending in an electric wire extraction direction of the electric wire extraction part; and a stopper preventing displacement of the protector-side lock part engaged with the locked part in the electric wire extraction direction, each of the pair of protector-side lock parts includes:

an arm flexibly deformable in a direction orthogonal to the electric wire extraction direction; and a locking claw part provided at a tip end of the arm, and the arms are flexibly deformed in opposite directions to allow the locking claw parts to be engaged with the locked parts upon the protector being assembled to the housing from the direction orthogonal to the electric wire extraction direction.

2. The shield connector according to claim 1, wherein the protector comprises:

a base member; and a cover connected to the base member through a hinge and capable of opening and closing at least a region of the base member toward an assembly direction of the base member.

3. The shield connector according to claim 2, wherein the base member comprises a bottom plate part and a pair of rising side parts rising from both of left and right ends of the bottom plate part, the cover has a shape of covering a top surface, left and right side surfaces, and a back surface of the base member, the hinge connects one of the rising side parts and one end of the cover to each other.

4. The shield connector according to claim 3, wherein the cover is capable of being displaced between:

a covering position covering spaces on the top surface, left and right side surfaces, and the back surface of the base member and an open position for opening the spaces on the top surface, left and right side surfaces, and the back surface of the base member based on the flexural deformation of the hinge.

5. The shield connector according to claim 2, wherein the base member comprises a pair of left and right protector-side auxiliary lock parts formed on the rising side parts of the protector together with the pair of left and right protector-side lock parts, the pair of left and right protector-side auxiliary lock parts are arranged inside of the protector-side lock parts, and each of the pair of left and right protector-side auxiliary lock parts comprises an upper stopper step surface formed on a top thereof.

6. The shield connector according to claim 1, wherein the housing includes a pair of housing-side auxiliary lock parts, the protector includes a pair of protector-side auxiliary lock parts, each of the pair of housing-side auxiliary lock parts includes a position restriction part extending in the electric wire extraction direction of the electric wire extraction part, and a stopper preventing displacement of the protector-side auxiliary lock part in the electric wire extraction direction, and the pair of protector-side auxiliary lock parts are engaged with the position restriction parts and the stoppers of the pair of housing-side auxiliary lock parts, upon the protector being assembled to the housing from the direction orthogonal to the electric wire extraction direction.

7. The shield connector according to claim 1, wherein a portion between the outer circumference of the housing and an inner circumference of the shield shell is sealed by a shell packing, and a unit packing is formed on the outer circumference of the housing.

8. The shield connector according to claim 1, wherein the terminal comprises a pair of terminals, an electric wire is connected to the pair of terminals, and the electric wire extends in the electric wire extraction direction from the housing, and is covered by the protector.

9. The shield connector according to claim 1, wherein the housing comprises a flange part provided at a back side of the housing, the flange part projecting in a direction orthogonal to the electric wire extraction direction are.

10. The shield connector according to claim 9, wherein the pair of left and right housing-side lock parts project from a surface of the flange part.

11. The shield connector according to claim 1, wherein the housing further comprises a pair of left and right housing-side auxiliary lock parts arranged inward from the pair of left and right housing-side lock parts.

12. The shield connector according to claim 11, wherein the housing comprises a flange part provided at a back side of the housing, the flange part projecting in a direction orthogonal to the electric wire extraction direction are, the pair of left and right housing-side auxiliary lock parts project from the surface of the flange part, and the pair of left and right housing-side auxiliary lock parts comprise position restriction parts extending in the electric wire extraction direction of the electric wire extraction part and stoppers.

13. The shield connector according to claim 11, wherein the shield shell comprises first insertion holes through which the pair of left and right housing-side lock parts are respectively inserted and second insertion holes through which the left and right housing-side auxiliary lock parts are respectively inserted.

* * * * *